US009803518B2

(12) United States Patent
Kubota

(10) Patent No.: US 9,803,518 B2
(45) Date of Patent: Oct. 31, 2017

(54) HYDRAULIC LASH ADJUSTER

(71) Applicant: NITTAN VALVE CO., LTD., Hadano-shi, Kanagawa (JP)

(72) Inventor: Yukio Kubota, Kanagawa (JP)

(73) Assignee: Nittan Valve Co., Ltd., Hadano-Shi, Kanagawa (JP)

( * ) Notice: Subject to any disclaimer, the term of this patent is extended or adjusted under 35 U.S.C. 154(b) by 0 days.

(21) Appl. No.: 15/111,072

(22) PCT Filed: Jan. 6, 2015

(86) PCT No.: PCT/JP2015/050144
§ 371 (c)(1),
(2) Date: Jul. 12, 2016

(87) PCT Pub. No.: WO2015/107937
PCT Pub. Date: Jul. 23, 2015

(65) Prior Publication Data

US 2016/0376936 A1 Dec. 29, 2016

(30) Foreign Application Priority Data

Jan. 20, 2014 (JP) ..... 2014-007795

(51) Int. Cl.
*F01L 1/18* (2006.01)
*F01L 1/24* (2006.01)

(52) U.S. Cl.
CPC ..... *F01L 1/24* (2013.01); *F01L 1/2405* (2013.01); *F01L 1/185* (2013.01); *F01L 2001/2444* (2013.01)

(58) Field of Classification Search
CPC ..... F01L 1/24; F01L 2001/2427; F01L 1/185; F01L 1/2405; F01L 2001/2444
(Continued)

(56) References Cited

U.S. PATENT DOCUMENTS 6,959,677 B2 11/2005 Mayer et al.
7,845,327 B2 * 12/2010 Tallio ..... F01L 1/053 123/90.52

FOREIGN PATENT DOCUMENTS

DE 19805511 A1 8/1999
DE 102008025036 A1 11/2009
(Continued)

OTHER PUBLICATIONS

Witten Opinion of the International Search Authority, dated Mar. 31, 2015, for PCT Application No. PCT/JP2015/050144.
(Continued)

*Primary Examiner* — Ching Chang
(74) *Attorney, Agent, or Firm* — Bruzga & Associates; Charles E. Bruzga; Shlomo S. Moshen

(57) ABSTRACT

In a lash adjuster used for a valve operating mechanism of an internal combustion engine, there is known a lash adjuster constituted by inserting a cylindrical sleeve into a plunger cap for preventing air from entering a high-pressure chamber located at a lower portion of the lash adjuster. However, in the conventional lash adjuster, since the plunger cap is formed with two side holes which are different in height in the axial direction of the plunger cap, it becomes complicated to regulate the side surface the plunger cap which corresponds to a sliding surface. Therefore, it is problems to be solved by the present invention to provide a lash adjuster in which the side surface of the plunger cap can be easily regulated without disturbing the inflow and outflow of oil and whose machining cost can be kept low.
The above problems can be solved by a hydraulic lash adjuster in which two or more cap side holes 27*c* are provided and all of them are disposed in a plane perpendicular to a shaft center of the body 21.

2 Claims, 5 Drawing Sheets

(58) Field of Classification Search
USPC ..... 123/90.46, 90.55, 90.45, 90.52
See application file for complete search history.

(56) References Cited

FOREIGN PATENT DOCUMENTS

| | | | |
|---|---|---|---|
| JP | 63-170509 | A | 7/1988 |
| JP | 01-114903 | U1 | 8/1989 |
| JP | 03-035208 | U1 | 4/1991 |
| JP | 04-125605 | U1 | 11/1992 |
| JP | 2008-232125 | A | 10/2008 |
| JP | 2010-261357 | A | 11/2010 |

OTHER PUBLICATIONS

International Preliminary Report on Patentability, dated Dec. 15, 2015, for PCT Application No. PCT/JP2015/050144.
European Search Report for European Application No. 15736942, dated Jul. 24, 2017.

* cited by examiner

A−A

HYDRAULIC LASH ADJUSTER

FIELD OF THE INVENTION

The present invention relates to a hydraulic lash adjuster used for an internal combustion engine.

BACKGROUND ART OF THE INVENTION

In a valve operating mechanism of the internal combustion engine, a lash adjuster is employed for correcting change in the gap between valves caused by abrasion, thermal expansion and the like. However, in the lash adjuster, if oil containing air is fed into a high-pressure chamber disposed at a lower portion of the lash adjuster, the lash adjuster cannot fulfil its function. In order to prevent air from being entrained into oil, each of a patent publication No. 1 and a patent publication No. 2 propose a method comprising the steps of inserting a cylindrical sleeve into a plunger cap and separating air contained in oil from the oil entering the high-pressure chamber.

PRIOR PUBLICATIONS

Patent Publications

Patent Publication No. 1: Japanese Patent Application Laid Open No. Sho 63-170509

Patent Publication No. 2: U.S. Pat. No. 6,959,677 B2

DISCLOSURE OF THE INVENTION

Problems to be Solved by the Invention

In the lash adjuster disclosed in the patent publication No. 1, the plunger cap is formed with two side holes which are different in height in the axial direction of the plunger cap and in the lash adjuster disclosed in the patent publication No. 2, a side hole for discharging air is provided in addition to an oil feeding opening. However, since it is necessary to regulate the side surface of the plunger cap for keeping good slidable characteristic, in the case where a plurality of side holes are provided so as to be spaced vertically in the axial direction of the plunger cap, it becomes complicated to regulate the side surface the plunger cap and the machining cost of the plunger cap becomes high. Thus, it is problems to be solved by the present invention to provide a lash adjuster in which the side surface of the plunger cap can be easily regulated without disturbing the inflow and outflow of oil and whose machining cost can be kept low.

Means for Solving Problems

The above problems can be solved by adopting the following technical means.

Specifically, a broad aspect of the invention is directed to a hydraulic lash adjuster comprising a bottomed cylindrical body 21 to be inserted into a fixing hole provided in an internal combustion engine, a bottomed cylindrical plunger 22 slidably inserted into a cylindrical portion 21*a* of the body 21, a plunger cap 27 being in contact with an upper surface of the plunger 22 and slidably inserted into the body 21, the plunger cap 27 comprising a large diameter portion 27*a* and a small diameter portion 27*b* disposed above the large diameter portion 27*a*, and a cylindrical sleeve 30 tightly inserted into the plunger cap 27, wherein oil is led to an inside of the plunger 27 through a body side hole 21*a* provided on a side surface of the body 21 and cap side holes 27*c* communicating with the body side hole 21*a* and provided on a side surface of the plunger cap 27, and a high-pressure chamber 42 is formed between a bottom portion 21*b* of the body 21 and a plunger bottom portion 22*b* of the plunger 22 by a check valve mechanism provided at the plunger bottom portion 22*b* of the plunger 22, the hydraulic lash adjuster being constituted so that two or more cap side holes 27*c* are provided and all of the cap side holes 27*c* are disposed in a plane perpendicular to a shaft center of the body 21, a portion located above the cap side holes 27*c* and formed on an outer periphery of the large diameter portion 27*a* of the plunger cap 27 is formed with an adjusting groove, and oil passing resistance in the portion located above the cap side holes 27*c* and formed on the outer periphery of the large diameter portion 27*a* of the plunger cap 27 inserted into the body 21 and slidable in the axial direction of the body 21 is lower than that in a portion located below the cap side holes 27*c*.

Further, a narrower aspect of the invention is directed to the hydraulic lash adjuster, wherein the adjusting groove is not parallel with the axial direction of the plunger cap 27.

Technical Effects of the Invention

According to the broad aspect of the invention, since two or more cap side holes 27*c* communicating with the body side hole 21*c* are provided, the oil passing resistance between the inside of the plunger cap 27 and an oil gallery 40 becomes low. As a result, low density oil containing air is easy of passing a gap between the inside of the plunger cap 27 and the oil gallery 40 and the amount of the low density oil containing air remaining in the plunger cap 27 is reduced. On the other hand, the amount of the low density oil containing air fed into the reserve chamber 41 is reduced.

Further, since all of the cap side holes 27*c* are disposed in a plane perpendicular to the shaft center of the body 21, it is possible to perform the edge working of the cap side holes 27*c* in one operation. Thus, the side surface of the sliding portions can be readily controlled and the machining cost can be reduced.

Moreover, since an even number of the cap side holes 27*c* are provided, two holes can be processed at one time from the side portion of the plunger cap 27. Thus, the machining cost can be further reduced.

In addition, since the oil passing resistance of the portion located above the cap side holes 27*c* and formed on the outer circumference of the large diameter portion 27*a* of the plunger cap 27 inserted into the body 21 and slidable in the axial direction is set to be lower than that of the portion below the cap side holes 27*c*, low density oil containing air passes through a space between the body 21 and the plunger cap 27 and therefore, the amount of the low density oil containing air fed into the reserve chamber 41 of the sleeve 30 can be reduced.

Furthermore, since the portion located above the cap side holes 27*c* and formed at the outer circumference of the large diameter portion 27*a* of the plunger cap 27 is formed with a adjusting groove, it is possible to adjust the oil passing resistance by controlling the width of the groove and the depth of the groove and the oil passage resistance can be easily adjusted.

According to the narrower aspect of the invention, in addition to the technical advantages obtained by the broader aspect of the invention, since the adjusting groove is not parallel with the axial direction of the plunger cap 27, the oil passing resistance can be adjusted by controlling the length of the adjusting groove and it is easier to change the oil passage resistance.

PREFERRED EMBODIMENT OF THE INVENTION

Preferred embodiments of the present invention configured based on the above described technical ideas will be explained below in detail referring to accompanying drawings.

Figure 5:
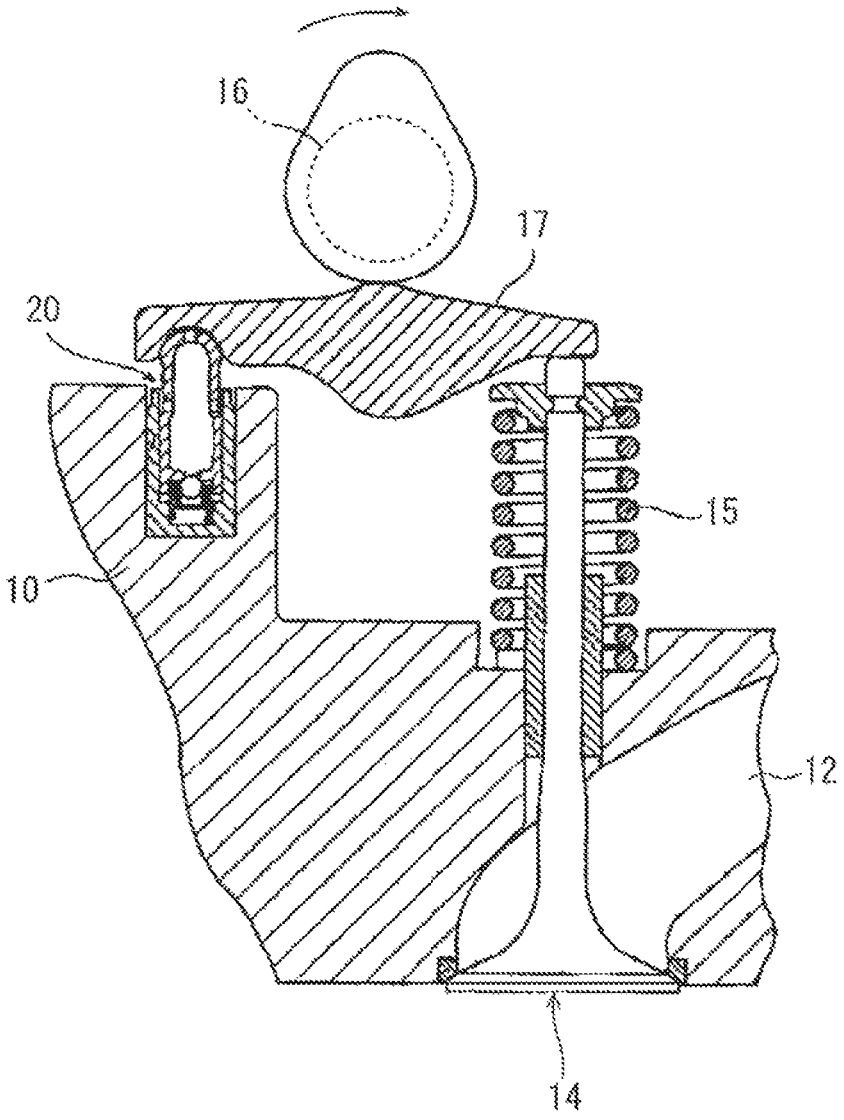
FIG. 5 is a schematic front cross-sectional view showing a valve operating mechanism using a conventional lash adjuster.

FIG. 5 is a schematic front cross-sectional view showing a valve operating mechanism using a conventional lash adjuster. A valve element 14 is disposed in an intake passage 12 formed in a cylinder head 10 constituting an internal combustion engine. The valve element 14 is biased by a return spring 15 toward a direction in which the intake passage 12 is closed and the upper end portion of the valve element 14 is in contact with a rocker arm 17 swingable in response to the rotation of a cam 16. A lash adjuster 20 is disposed adjacent to the valve element 14 and inserted into a fixing hole provided in the cylinder head 10 and opening upwardly, thereby being fixed therein. The lash adjuster 20 is used for correcting change in the gap of the valves caused by the abrasion of the valve operating mechanism and thermal expansion thereof.

Figure 1:
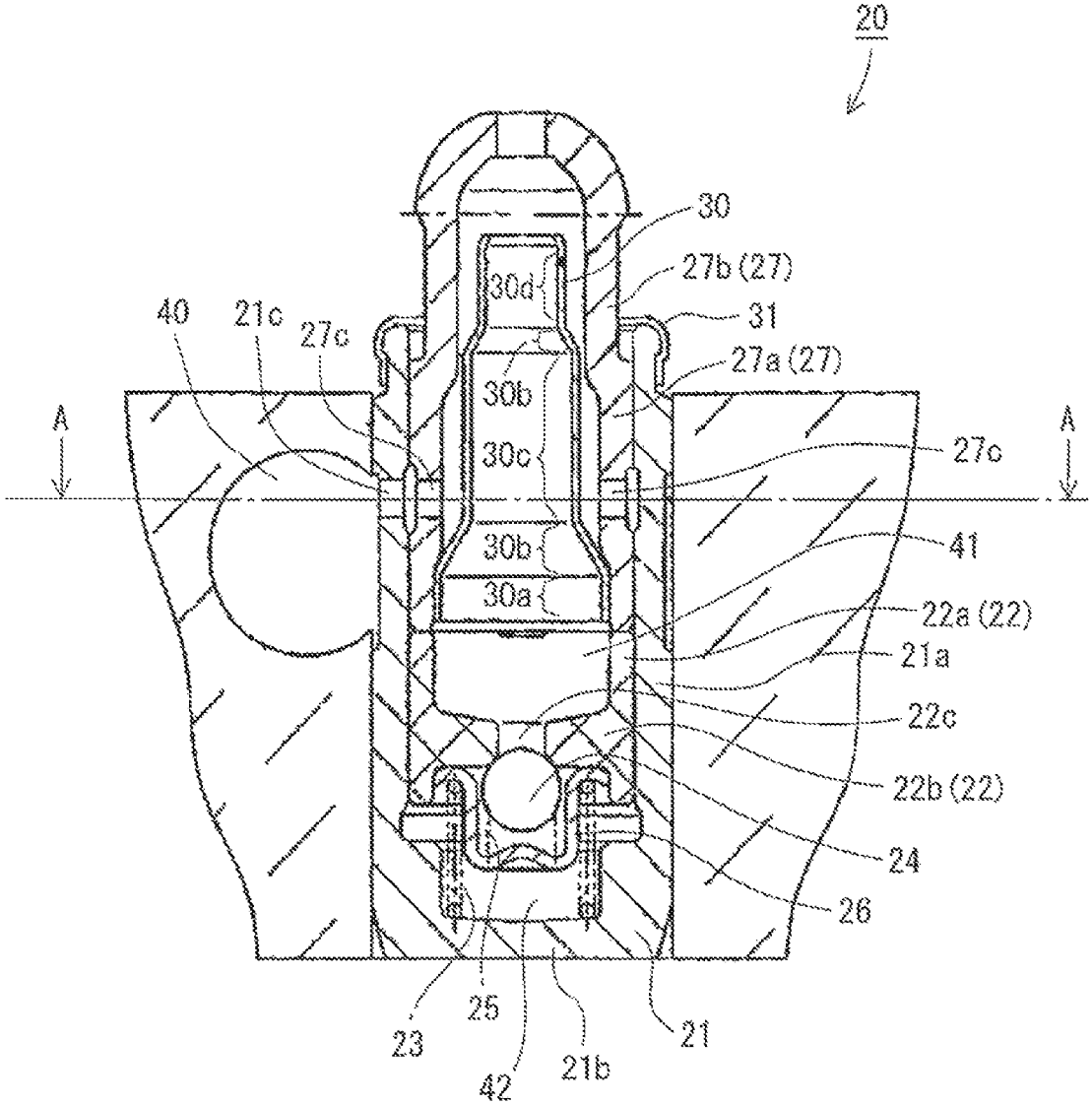
FIG. 1 is a schematic front cross-sectional view showing a lash adjuster which is a first preferred embodiment of the present invention.
Figure 2:
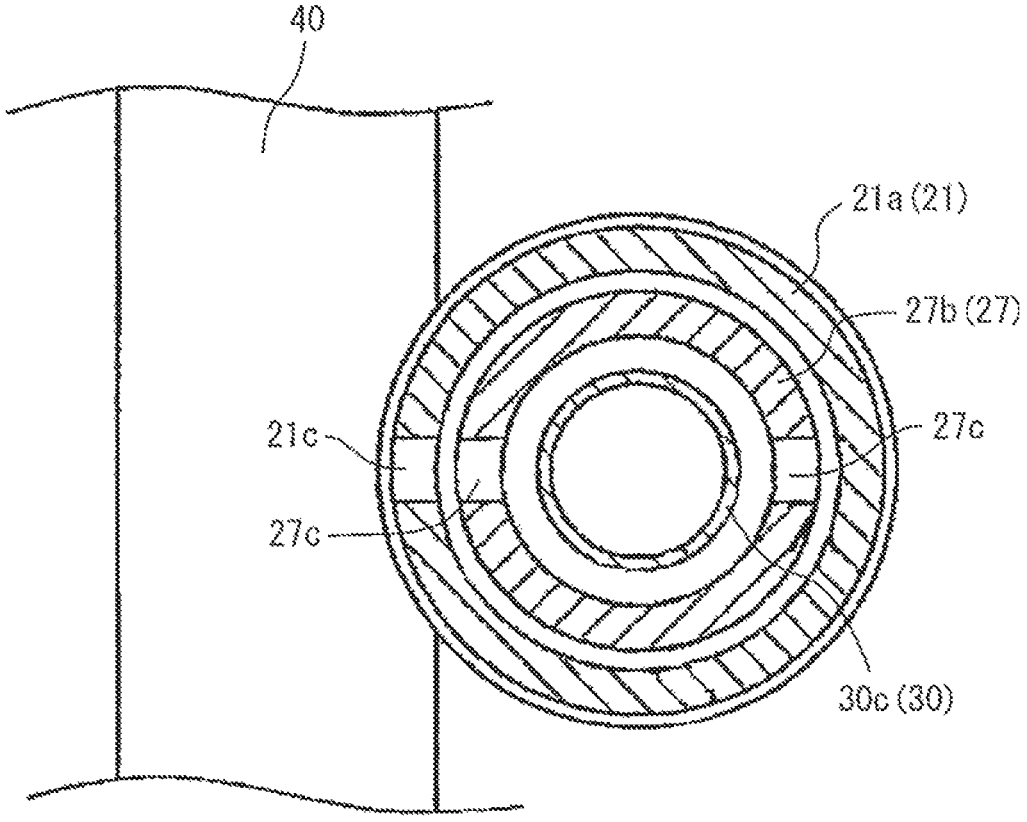
FIG. 2 is a schematic sectional plan view of the lash adjuster shown in FIG. 1.

FIG. 1 is a schematic front cross-sectional view (in an axial direction) showing a lash adjuster which is a first preferred embodiment of the present invention and FIG. 2 is a schematic sectional plan view of the lash adjuster taken along a line A-A in FIG. 1. In this specification, the "top and bottom" of the lash adjuster 20 means the "top and bottom" thereof in FIG. 1. The lash adjuster includes a bottomed cylindrical body 21, a bottomed cylindrical plunger 22, a plunger cap 27 in contact with the upper surface of the plunger 22 and a cylindrical sleeve 30 tightly inserted into the plunger cap 27.

The lash adjuster 20 is fixed by inserting a body 21 thereof into a fixing hole formed in the cylinder head 10 (FIG. 5) of the internal combustion engine. The body 21 is provided with a cylindrical portion 21*a* and a bottom portion 21*b* and the plunger 22 and the plunger cap 27 are slidably inserted into the cylindrical portion 21*a* of the body 21 from above. The cylindrical portion 21*a* of the body 21 is provided with a body side hole 21*c* through which oil is fed from an oil gallery 40. The body side hole 21*c* is perpendicular to the shaft center of the body 21 and is formed so as to penetrate through the cylindrical portion 21*a*. A groove whose width is larger than the diameter of the body side hole 21*c* is formed on the inner periphery of the cylindrical portion 21*a* so that the inflow and outflow of oil becomes smooth.

The plunger 22 inserted into the lower portion of the body 21 includes a cylindrical portion 22*a* and a bottom portion 22*b* integrally formed therewith. The inside of the lash adjuster 20 is divided by a check valve mechanism provided at the bottom portion 22*b* into a reserve chamber 41 and a high-pressure chamber 42. The check valve mechanism includes a vertical communication hole 22*c* formed in substantially the center of the bottom portion 22*b* of the plunger 22, a check ball 24 located below the vertical communication hole 22*c* to be in contact with the lower portion of the vertical communication hole 22*c*, a ball cage 26 for holding the check ball 24 and a spring 25 disposed in the ball cage 26 and adapted for biasing the check ball 24 upwardly. The ball cage 26 is supported by a plunger spring 23 for biasing the plunger 27 upwardly.

While the plunger cap 27 is subjected to a downward force by the check valve mechanism, oil in the high-pressure chamber 42 cannot pass through the vertical communication hole 22*c*, whereby the upper portion of the lash adjuster 20 serves as a pivot point of the rocker arm 17 (FIG. 5). On the other hand, when the plunger cap 27 is not subjected to the downward force, the plunger 22 and the plunger cap 27 are lifted, whereby oil accommodated in the reserve chamber 41 passes through the vertical communication hole 22*c* and flows into the high-pressure chamber 42.

Similarly to the plunger 22, the plunger cap 27 is slidably inserted in the body 21. The plunger cap 27 includes a large diameter portion 27*a* slidable on the body 21 and a small diameter portion 27*b* located above the large diameter portion 27*a*. The upper portion of the small diameter portion 27*b* has a hemispherical shape, which comes into contact with the rocker arm 17. The upper end portion of the small diameter portion 27*b* is formed with an oil passing hole in the vertical direction, thereby overflowing oil from the lash adjuster 20 and lubricating the valve operating mechanism. The lower surface of the plunger cap 27 is in contact with the upper surface of the plunger 22 and slides substantially integrally with the plunger 22 in the vertical direction.

The plunger cap 27 is provided with two cap side holes 27*c*. The cap side holes 27*c* are disposed so as to communicate with the body side hole 21*c*, whereby oil is led from the oil gallery 40 provided in the cylinder head 10 (FIG. 5) to the inside of the plunger 22 and mobile oil containing air and having low density is led into the oil gallery 40. The two body side holes 27*c* are disposed in a plane perpendicular to the shaft center of the body 21. In the case where two or more cap side holes 27*c* are provided, they are disposed similarly to the case where the two cap side holes 27*c* are provided. Here, "what are disposed in a plane" includes the shaft center of the cap side holes 27*c* or a part of the cap side holes 27*c*.

The cap side holes 27*c* of the plunger cap 27 are perpendicular to the shaft center of the body 21 and penetrate the large diameter portion 27*a* of the plunger cap 27. On the outer periphery side of the large diameter portion 27*a*, a groove having a width larger than the diameter of the cap side holes 27*c* is formed in a circumferential direction, thereby facilitating the inflow of oil from the body side hole 21*c* and the outflow of oil from the cap side holes 27*c*. The diameter of the large diameter portion 27*a* of the plunger cap 27 which slides on the body 21 is different between a portion upper than the cap side holes 27*c* and a portion lower than the cap side holes 27*c*. Specifically, the portion upper than the groove and including the cap side holes 27*c* has a smaller diameter than that of the portion lower than the groove so that the passing resistance of oil becomes small through a space between the body 21 and the large diameter portion 27*a*.

The upper open end of the body 21 is formed with a cap retainer 31 for holding the plunger cap 27 so as to prevent the plunger 22 and the plunger cap 27 from falling off the body 21 when assembling the lash adjuster 20.

A sleeve 30 having a cylindrical shape is tightly inserted into an inner circumferential portion of the large diameter portion 27*a* of the plunger cap 27. The sleeve 30 has open opposite end portions and is constituted by three cylindrical portions having different diameters from each other and disposed along the axial direction. What is tightly inserted into the plunger cap 27 is a larger diameter portion 30*a* having a largest diameter. The sleeve 30 has a first small diameter portion 30*c* having a smaller diameter than that of the larger diameter portion 30*a* above the larger diameter portion 30*a* and a second small diameter portion 30*d* having a smaller diameter than that of the first small diameter portion 30*c* above the first small diameter portion 30*c*. A taper portion 30*b* is formed between the larger diameter portion 30*a* and the first small diameter portion 30*c* and a taper portion 30*b* is also formed between the first small diameter portion 30*c* and the second small diameter portion 30*d*, whereby the sleeve 30 can be integrally formed. In addition, a gap between the inner surface of the small diameter portion 27*b* of the plunger cap 27 and the outer surface of the first small diameter portion 30*c* of the sleeve 30 is constituted small. According to such configuration, since the resistance of oil passing through the gap between the small diameter portion 27*b* and the first small diameter portion 30*c* becomes high, much oil passes through the body side hole 21*c* and the cap side holes 27*c* so that low density oil containing air is prevented from being stored in the reserve chamber 41.

Since two or more cap side holes 27*c* communicating with the body side hole 21*c* are provided, the resistance of oil passing through a space between the inside of the plunger cap 27 and the oil gallery 40 becomes low. As a result, low density oil containing air is easy of passing through a gap between the inside of the plunger cap 27 and the oil gallery 40 and the amount of the low density oil containing air remaining in the plunger cap 27 is reduced. In addition, the amount of the low density oil containing air fed into the reserve chamber 41 is reduced.

Further, since all of the cap side holes 27*c* are disposed in a plane perpendicular to the shaft center of the body 21, it is possible to perform the edge working of the cap side holes 27*c* in one operation. Thus, the side surface of the sliding portions can be readily regulated and the machining cost can be reduced.

Since an even number of the cap side holes 27*c* are provided, two holes 27*c* can be processed at one time from the side portion of the plunger cap 27. Thus, the machining cost can be further reduced.

Since the passing resistance of oil in the portion located above the cap side holes 27*c* and formed on the outer circumference of the large diameter portion 27*a* of the plunger cap 27 inserted into the body 21 and slidable in the axial direction is lower than that of the portion below the cap side holes 27*c*, low density oil containing air passes through a space between the body 21 and the plunger cap 27 and, therefore, the amount of the low density oil containing air fed into the reserve chamber 41 in the sleeve 30 can be reduced.

Figure 3:
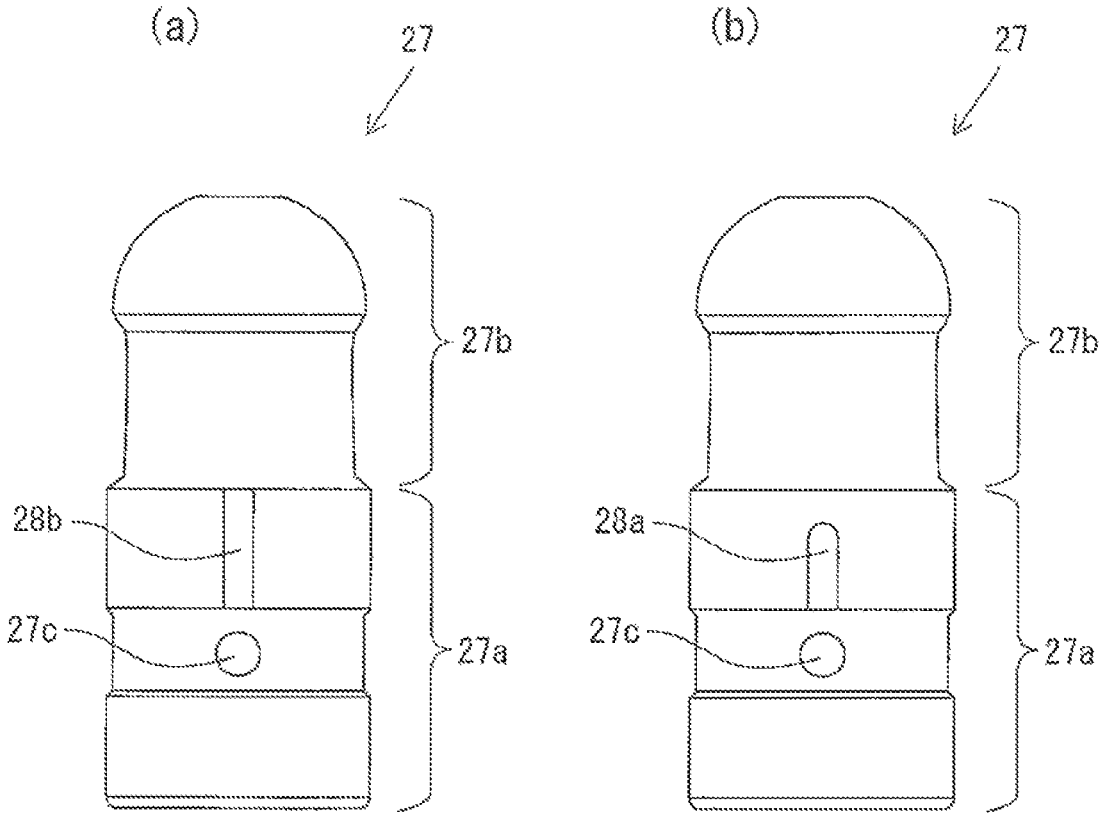
FIG. 3 is a schematic front view of a plunger cap constituting a lash adjuster which is a second preferred embodiment of the present invention.
Figure 4:
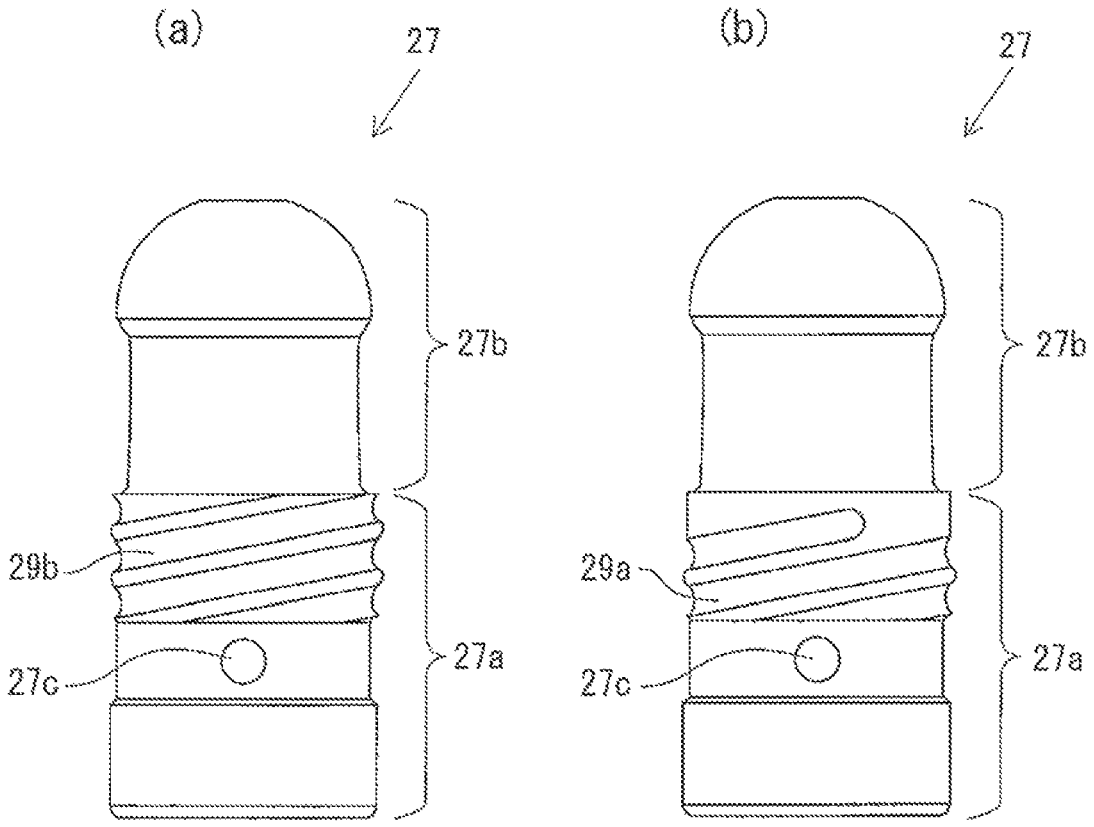
FIG. 4 is a schematic front view of a plunger cap constituting a lash adjuster which is a third preferred embodiment of the present invention.

FIG. 3 is a schematic front view of a plunger cap 27 constituting a lash adjuster 20 that is a second preferred embodiment of the present invention and FIG. 4 is a schematic front view of a plunger cap 27 constituting a lash adjuster 20 that is a third preferred embodiment of the present invention.

In the second preferred embodiment of the present invention, a portion above the cap side hole 27*c* formed at the outer circumference of the large diameter portion 27*a* of the plunger cap 27 is formed with parallel adjusting grooves 28*a*, 28*b* through which oil can pass. FIG. 3 (*a*) shows parallel adjusting groove 28*b* which communicates an upper portion and a lower portion and FIG. 3 (*b*) shows parallel adjusting groove 28*a* which does not communicate the upper portion and the lower portion.

Since the portion above the cap side hole 27*c* formed at the outer circumference of the large diameter portion 27*a* of the plunger cap 27 is formed with parallel adjusting groove 28*a* or 28*b* through which oil can pass, it is possible to adjust the oil passing resistance by controlling the width of the groove and the depth of the groove and, therefore, the oil passage resistance can be easily adjusted.

In the third preferred embodiment of the present invention, a portion located above the cap side hole 27*c* and formed on the outer circumference of the large diameter portion 27*a* of the plunger cap 27 is formed with non-parallel adjusting grooves 29*a*, 29*b* through which oil can pass. FIG. 4 (*a*) shows the non-parallel adjusting groove 29*b* which communicates an upper portion and a lower portion and FIG. 4 (*b*) shows non-parallel adjusting groove 29*a* which does not communicate the upper portion and the lower portion. The non-parallel adjusting grooves 29*a* or 29*b* is formed at an angle of 45 degrees or more (75 degree in this embodiment) to the shaft center of the plunger cap 27, thereby lengthening the adjusting groove.

Since the adjusting groove is not parallel with the axial direction of the plunger cap 27, the oil passing resistance can be adjusted by controlling the length of the adjusting groove and it is easier to adjust the oil passage resistance.

EXPLANATION OF REFERENCE NUMERALS

10 a cylinder head
12 an intake passage
14 a valve element
15 a return spring
16 a cam
17 a rocker arm
20 a lash adjuster
21 a body
21*a* a cylindrical portion
21*b* a bottom portion
21*c* a body side hole
22 a plunger
22*a* a cylindrical portion of a plunger
22*b* a bottom portion of a plunger
22*c* a vertical communication hole
23 a plunger spring
24 a check ball
25 a spring
26 a ball cage
27 a plunger cap
27*a* a large diameter portion
27*b* a small diameter portion
27*c* a cap side hole
28*a*, 28*b* a parallel adjusting groove
29*a*, 29*b* a non-parallel adjusting groove
a sleeve
30*a* a large diameter portion

30*b* a taper portion
30*c* a first small diameter portion
30*d* a second small diameter portion
31 a cap retainer
40 an oil gallery
41 a reserve chamber
42 a high-pressure chamber

The invention claimed is:

1. A hydraulic lash adjuster comprising:

a bottomed cylindrical body to be inserted into a fixing hole provided in an internal combustion engine, a bottomed cylindrical plunger slidably inserted into a cylindrical portion of the bottomed cylindrical body, a plunger cap being in contact with an upper surface of the bottomed cylindrical plunger and slidably inserted into the bottomed cylindrical body, the plunger cap including a large diameter portion and a small diameter portion located above the large diameter portion, and a cylindrical sleeve tightly inserted into the plunger cap, wherein oil is led to an inside of the bottomed cylindrical plunger through a body side hole provided on a side surface of the bottomed cylindrical body and a cap side hole communicating with the body side hole and provided on a side surface of the plunger cap, a high-pressure chamber is formed between a bottom portion of the bottomed cylindrical body and a plunger bottom portion of the bottomed cylindrical plunger by a check valve mechanism provided at the plunger bottom portion of the bottomed cylindrical plunger, the hydraulic lash adjuster being constituted so that two cap side holes are provided and are disposed in a plane perpendicular to a shaft center of the bottomed cylindrical body, a portion located above the cap side holes and formed on an outer periphery of the large diameter portion of the plunger cap is formed with an adjusting groove, and oil passing resistance in the portion located above the cap side holes and formed on the outer periphery of the large diameter portion of the plunger cap inserted into the bottomed cylindrical body and slidable in the axial direction of the bottomed cylindrical body is lower than that in a portion located below the cap side holes.

2. A hydraulic lash adjuster in accordance with claim 1, wherein the adjusting groove is not parallel with an axial direction of the plunger cap.

* * * * *